US006401649B1

(12) United States Patent
Smith

(10) Patent No.: US 6,401,649 B1
(45) Date of Patent: Jun. 11, 2002

(54) MAGNETIC BOOKMARK

(76) Inventor: Tamie K. Smith, 39255, Grassy Rd., CA (US) 92592

( * ) Notice: Subject to any disclaimer, the term of this patent is extended or adjusted under 35 U.S.C. 154(b) by 0 days.

(21) Appl. No.: 09/507,295

(22) Filed: Feb. 18, 2000

Related U.S. Application Data

(60) Provisional application No. 60/121,083, filed on Feb. 19, 1999.

(51) Int. Cl.[7] ..... B42D 9/00

(52) U.S. Cl. ..... 116/234; 281/42

(58) Field of Search ..... 116/234, 235, 116/236, 237, 238, 239, 240; D19/32–34; 281/30, 42; 402/503

(56) References Cited

U.S. PATENT DOCUMENTS

| | | | | | |
|---|---|---|---|---|---|
| 2,448,611 | A | * | 9/1948 | Martin | 116/234 |
| 3,529,328 | A | * | 9/1970 | Davison | 24/303 |
| 3,584,572 | A | * | 6/1971 | Apicella | 101/24 |
| 3,898,951 | A | * | 8/1975 | Clare | 116/239 |
| 4,041,892 | A | * | 8/1977 | Nichols | 116/239 |
| 4,236,331 | A | * | 12/1980 | Mattson | 40/1.5 |
| 4,249,267 | A | * | 2/1981 | Voss | |
| 4,255,837 | A | * | 3/1981 | Holtz | 24/303 |
| 4,258,493 | A | * | 3/1981 | Kettlestrings et al. | 40/600 |
| 4,505,219 | A | * | 3/1985 | Mangano | 116/234 |
| 4,573,821 | A | * | 3/1986 | Gilreath | 402/78 |
| 4,688,510 | A | * | 8/1987 | McNeely | 116/237 |
| 4,932,351 | A | * | 6/1990 | Capamaggio | 116/237 |
| 4,934,304 | A | * | 6/1990 | Rosen | 116/237 |
| 5,022,342 | A | * | 6/1991 | Davis | 116/236 |
| 5,103,756 | A | * | 4/1992 | Korkames | 116/234 |
| 5,103,758 | A | * | 4/1992 | Clark | 116/237 |
| 5,249,546 | A | * | 10/1993 | Pennelle | 116/234 |
| 5,325,811 | A | * | 7/1994 | Miroyan | 116/235 |
| 5,325,959 | A | * | 7/1994 | Goldberger | 206/5 |
| 5,375,884 | A | * | 12/1994 | Farrington | 281/42 |
| 5,377,820 | A | * | 1/1995 | Christman | 206/6.1 |
| 5,456,497 | A | * | 10/1995 | Russ, Jr. | 281/42 |
| 5,458,081 | A | * | 10/1995 | Reichert | 116/234 |
| 5,682,653 | A | * | 11/1997 | Berglof et al. | 24/303 |
| 5,876,145 | A | * | 3/1999 | Datum | 402/4 |

FOREIGN PATENT DOCUMENTS

| | | | | |
|---|---|---|---|---|
| NL | 53682 | * | 12/1942 | 116/234 |

* cited by examiner

*Primary Examiner*—Diego Gutierrez
*Assistant Examiner*—R. Alexander Smith
(74) *Attorney, Agent, or Firm*—George W. Dishong

(57) ABSTRACT

A magnetic placemarker that remains in place regardless of the orientation of the document, where multiple pages are to be marked, where a place on the page is to be marked, or where the adhesive properties of the marker are to remain stable, among other things. The invention resides specifically in the means to attach the marker via opposing magnets on flaps to be folded over or surrounding a page or pages in a document.

10 Claims, 3 Drawing Sheets

MAGNETIC BOOKMARK

CROSS-REFERENCE TO RELATED APPLICATIONS

This application claims the benefit of Provisional Application Ser. No. 60/121,083 filed on Feb. 19, 1999, entitled MAGNETIC BOOKMARK.

STATEMENT REGARDING FEDERALLY SPONSORED RESEARCH OR DEVELOPMENT

Not Applicable.

BACKGROUND OF THE INVENTION

1. Field of the Invention

This invention most generally relates to a magnetic device that can be used to mark places in books, magazines, newspapers, among other documents, and protrudes from the edge of the document to clearly indicate the placemark's location. More particularly the invention relates to placemarkers that can mark any number of locations in the subject document. Most particularly the invention relates to a placemarker that does not fall out of the document when the document is re-oriented, shaken, or dropped.

2. Description of the Related Art

Presently, inventions exist for placemarkers that protrude from the edge of the document, mark multiple places, mark multiple pages, and can be secured to the book. These inventions solve particular problems such as creating thumb tabs on document edges, accommodating readers who require multiple marks in the same document, and insuring that the bookmark does not fall out of the book.

U.S. Pat. No. 5,249,546 discloses a placemarker that projects away from a side page in the volume so that it may fold over edges of the pages to act as a bookmark and also a thumbtab. This invention's securing means is adhesive, a substance that loses its ability to remain securely fastened with repeated applications.

U.S. Pat. No. 5,022,342 discloses a placemarker that marks multiple locations in a document by including a plurality of strings with two moveable place markers on each string. This invention also provides an anchor means consisting of a spring clamp for securing the bookmark to the spine of the book. This invention requires a document equipped with a spine in order to enable its securing mechanism. In addition, its multiple location markers could slide out of place when the book is re-oriented, dropped, or shaken.

U.S. Pat. No. 5,375,884 discloses a bookmark with a U-shaped attachment member that bends snugly over book spine and binding. The marking portion is connected to the attachment portion by a bendable thread section. This bookmark requires a book with a spine and binding, and thus can't accommodate other types of documents.

U.S. Pat. No. 4,932,351 discloses a bookmark that consists of a molded plastic base that is clamped to the book. Again, this invention is not generally applicable to all types of documents.

U.S. Pat. No. 5,458,081 discloses a bookmark fitted with anchors that hold its corded markers from being pulled out of the book. This bookmark is adjustable to fit the length of a book, i.e. it could not be used to mark, for example, newspapers because its anchors must protrude from the opposite end of the document from which the folded cord top is positioned.

U.S. Pat. No. 4,688,510 discloses a place marker that clips onto a page via a spring. It consists of three separate "leaves" that are used in slidable conjunction with one another. This rather complicated device would not serve the purpose of a simple device to mark where one has left off reading a book.

U.S. Pat. No. 5,103,758 discloses a clip-type bookmark that consists of a ribbon connected to a clip that is used to mark a place in a document. This bookmark serves a similar purpose to the instant invention, but is not so reliable a marker when too many pages are caught up in the clip, as this situation would render the clip useless for maintaining its position during handling of the book.

In general, the devices that are designed to catch up several pages are complicated or limited. Devices that are designed to remain securely attached to the document are fairly complicated, involving moving and inter-operating parts, and are physically cumbersome. And devices that serve to mark multiple pages in a document are restricted to certain document sizes and shapes. These devices are neither geared towards simplicity, in the case of solving the fixed attachment problem, nor flexibility, in the case of solving the multiple page fixed attach problem.

The patents noted herein provide considerable information regarding the developments that have taken place in the field of placemarkers. Clearly the instant invention provides many advantages over the prior art inventions noted above. Again it is noted that none of the prior art meets the objects of providing:

simplicity in construction and operation, multiple page marking; and secure fastening.

None of the inventions of the prior art are as effective and as efficient as the instant invention in ensuring that the bookmark, no matter which embodiment, remains in the book even when the book is shaken, tossed, or dropped.

BRIEF SUMMARY OF THE INVENTION

A placemarker that stays in place through magnetic force is disclosed. In the first embodiment, the placemarker folds over or surrounds the desired page or pages, and the opposing but connected fold flaps attract one another through magnets that are affixed onto the flaps. In the second embodiment, the placemarker comprises a plurality of substrates, all connected at their proximal ends, each, except the substrates which surround the plurality of substrates, affixed with a magnet on each side of each substrate at the distal ends of the substrates. The outer substrates, which surround the plurality of substrates, are affixed only on their inward-facing substrate surface distal ends with magnets. In either embodiment, the flaps or substrates become securely fastened to each other around the pages of the document, and the placemarker does not fall out of the document.

In the first embodiment, a placemarker removably attachable to at least one page of a document is disclosed. The placemarker comprises a substrate having edges defining thereby a predetermined and selected geometry whereby the selected geometry has an averaged width dimension and an averaged length dimension. The substrate is formed of a material which has an outward-facing surface on which indicia may be configured and an inward-facing surface separated from the outward-facing surface by an averaged thickness dimension. In addition, the placemarker comprises a means for causing foldability of the substrate located such that when the substrate is folded, a substrate first portion and a substrate second portion are created thereby, each said substrate first portion and substrate second portion having a surface area determined by the averaged width dimension and the averaged length dimension and the location of the means for causing foldability. The placemarker further comprises a first magnet segment securely affixed to an inward-facing surface of the substrate first portion. Finally, in the invention of the first embodiment, the placemarker comprises a second magnet segment securely affixed to an inward-facing surface of the substrate second portion. Each first magnet segment and second magnet segment are oriented to be mutually attracted when the substrate is folded so that the inward-facing surfaces of the substrate are proximate each to the other.

In the first embodiment, the placemarker can also comprise, but doesn't have to, an item attached to the outward-facing surface of at least one of substrate first portion and substrate second portion. Further, the material of the placemarker can be, but doesn't have to be, selected from the group consisting of cloth, paper, paperboard, plastic, metals, metal alloys, and wood. The item of the placemarker of the first embodiment can be, but doesn't have to be, at least one selected from the group consisting of buttons, sprinkles, charms, and photos. The predetermined and selected geometry defined by the edges of the placemarker of the first embodiment can be, doesn't have to be, selected from at least one of the group consisting of polygonal, arcuate, irregular, symbols, animals, characters and plants.

The placemarker of the first embodiment in which the placemarker consists of a substrate having predetermined geometric shape and predetermined area dimension, in which the substrate is formed of a material which has an outward-facing surface and two opposing inward-facing surfaces, and in which the outward-facing surface is suitable for placing indicia thereon, can be made by a process comprising cutting a section of the substrate to the predetermined geometric shape and predetermined area dimension and then securely attaching a magnet to each of the opposing inward-facing surfaces.

The process for making the placemarker of the first embodiment can further comprise placing the indicia on the outward-facing surface by a process selected from a group consisting of stamping, embossing, and glittering. The process can further comprise affixing ornaments from a group consisting of buttons and charms to said outward-facing surface.

In the second embodiment, a placemarker removably attachable to at least one page of a document is disclosed that comprises a plurality of substrates each having proximal and distal ends, each having edges defining thereby a predetermined and selected geometry whereby said selected geometry has an averaged width dimension and an averaged length dimension, and wherein each substrate is formed of a material. The placemarker of the second embodiment also comprises a means for connecting each substrate to the plurality of each of the other substrates at proximal ends of all the substrates forming a stack of substrates having outward-facing surfaces on each of two outward-facing sides of the stack. Indicia may be placed on the outward-facing surfaces. The placemarker also comprises a plurality of inward-facing surfaces on any surface of the substrate that is not an outer-facing surface. Finally, the second embodiment of the placemarker comprises a magnet segment securely affixed to any inward-facing surface of each of the substrates at the distal ends of each of the substrates. The magnet segments are oriented to be mutually attracted when the substrates are positioned so that the inward-facing surfaces of two substrates are proximate each to the other.

The second embodiment of the placemarker can further comprise an item attached to at least one of said outward-facing surfaces of said substrates. Also, the material of the second embodiment of the placemarker can be selected from the group consisting of cloth, paper, paperboard, plastic, metal metal alloys, and wood. The item of the second embodiment of the placemarker can be at least one selected from the group consisting of buttons, sprinkles, charms, and photos.

A process for making a removably attachable placemarker of the second embodiment, wherein the placemarker consists of a plurality of substrates with proximal and distal ends, each having edges defining thereby a predetermined and selected geometry whereby said selected geometry has an averaged width dimension and an averaged length dimension, comprising cutting a plurality of inner sections of the substrate to said predetermined geometric shape and predetermined area dimension forming a plurality of inner section substrates each with two surfaces, one on each side of each substrate, and each with proximal and distal ends. The process for making the placemarker of the second embodiment further comprises securely attaching a magnet to each of the two surfaces on each distal end of each inner section substrate, wherein the magnet segments are oriented to be mutually attracted when the substrates are positioned so that the distal ends of the substrates are opposing and proximate each to the other. The process further comprises cutting two outer sections of the substrate to the predetermined geometric shape and predetermined area dimension forming two outer section substrates each with an outward-facing surface and an inward-facing surface, and each with proximal and distal ends. The process further comprises securely attaching a magnet segment to each of the two inward-facing surfaces of each outer section substrate on the outer section distal ends, wherein the magnet segments are oriented to be attracted to each distal end of each inner section substrate when each inward-facing surface of each outer section substrate is positioned proximate to the distal end of the inner section substrate. The process further comprises connecting each of the plurality of inner section substrates to one another at proximal ends forming a stack of inner section substrates having two outer sides. The process further comprises connecting one of the outer section substrates to one outer side of the stack of inner section substrates at the proximal ends of both the outer section substrate and the stack of inner section substrates, wherein the inward-facing surface faces one outer side of the stack of inner section substrates. Finally, the process comprises connecting the other outer section substrate to the other outer side of the stack of inner section substrates at said proximal ends of both outer section substrate and the stack of inner section substrates, wherein said inward-facing surface faces the other outer side of the stack of inner section substrates.

The process can further comprise creating a design on at least one outward-facing surface by a process selected from a group consisting of stamping, embossing, and glittering. The process can further comprise affixing ornaments from a group consisting of buttons and charms to one outward-facing surface.

The placemarker of the present invention has the particular objective and advantage of remaining in the marked location no matter how the document is oriented, and no matter how many times the marker is used. This is because magnets, unlike adhesive or clip markers, do not lose their adhesive properties, nor stretch from use, nor vary in their ability to securely fasten after repeated use.

The placemarker of the present invention can accommodate situations where multiple marks are desired or where it is desired to mark a specific location on a page of the document. In one embodiment of the invention, the marker is constructed of a folded rectangular piece of sturdy but flexible material, on which inner sides of the folded material are affixed magnets. This embodiment of the marker can be folded over one or several pages, anywhere on the page to thus mark a specific location at which point, perhaps, reading was suspended. In another embodiment, a plurality of substrates of sturdy but flexible material are permanently or semi-permanently connected at proximal ends with each other, and onto which distal ends are affixed magnets. In pairs, these substrates can surround or be interleaved with one or several pages and be securely attached to each other, in pairs, at distal ends. Thus, the number of marks possible in this multi-substrated marker depends on the number of substrates.

An object of the invention is to provide a means for securely marking a place within a document such that the placemarker does not fall out when the document is dropped, shaken, or turned upside-down.

A further object of the invention is to provide for sustained, and indeed unlimited, life of the marker such that the adhesive properties or spring action of the marker remain in tact after an unlimited number of uses.

A still further object of the invention is to provide a means for securely marking multiple pages of a document with one marker.

A yet still further object of the invention is to provide a means for marking a position on a page at which, for example, reading was suspended.

These and further objects of the present invention will become apparent to those skilled in the art to which this invention pertains and after a study of the present disclosure of the invention.

DETAILED DESCRIPTION OF THE INVENTION

Figure 1:
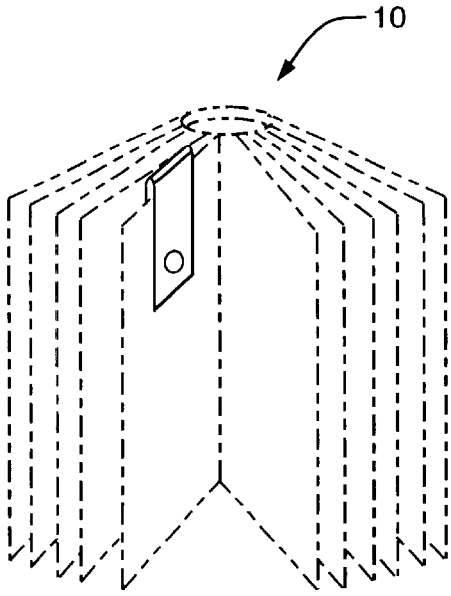
FIG. 1 is an illustration of one embodiment of the invention as used.
Figure 4:
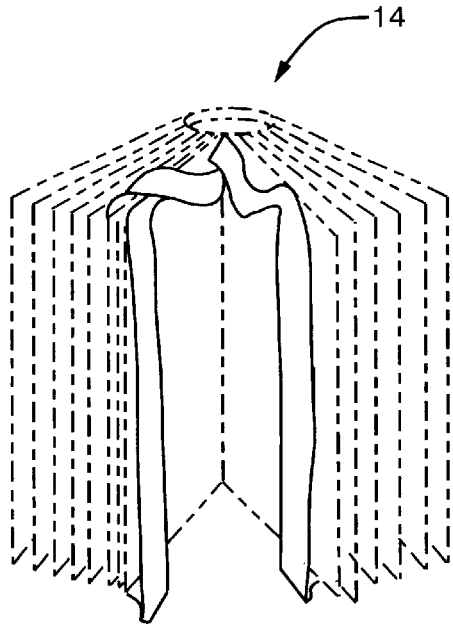
FIG. 4 is an illustration of the use of another embodiment of the invention.
Figure 2:
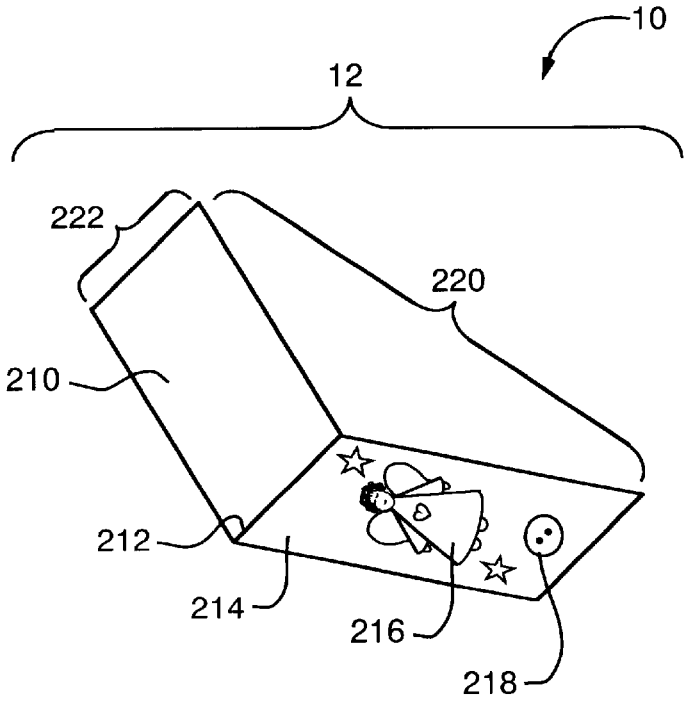
FIG. 2 is a perspective view of one side of one embodiment of the invention.
Figure 3:
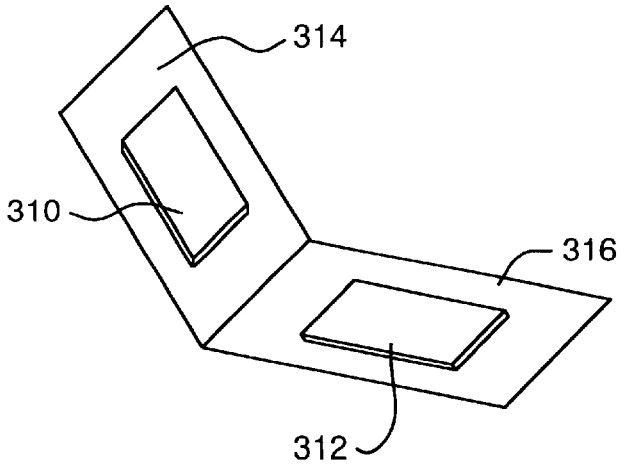
FIG. 3 is a perspective view of the other side of one embodiment of the invention.
Figure 5:
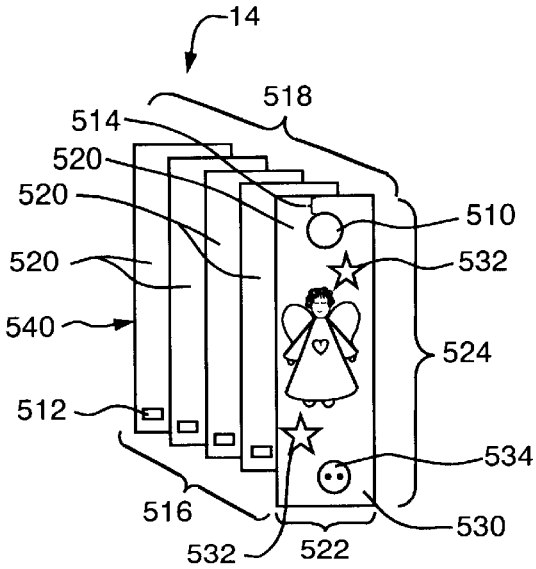
FIG. 5 is a perspective view of the various parts of the embodiment of FIG. 4.
Figure 6A:
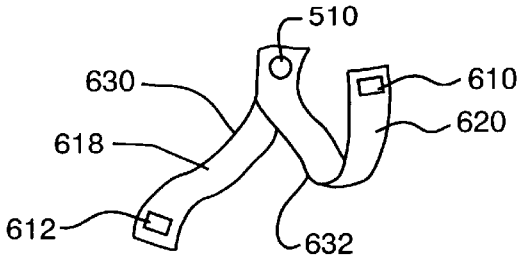
FIGS. 6A and 6B are perspective views of the detail of the substrate and magnet construction in the embodiment of FIG. 4.
Figure 6B:
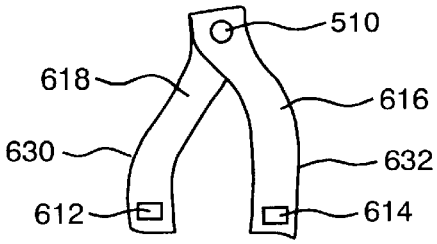

Referring to FIGS. 1, 2, and 3, embodiment 10 is a bookmark that can be removably attachable to at least one page of a document or book, said bookmark comprising substrate 12 having predetermined averaged width 222 and averaged length 220 dimensions, substrate 12 being formed of a material which has outward-facing surface 214 on which indicia 216 and ornaments 218 may be placed. Substrate 12 is fabricated with a means for causing substrate 12 to be foldable, said means, in the preferred embodiment, located substantially about midpoint 212 of length dimension 220 thereby creating substrate portions 210 and 214. Magnetic segment 310 is securely affixed to inward-facing surface 314 of substrate 210, and magnetic segment 312 is securely affixed to inward-facing surface 316 of substrate 214. Magnetic segments 310 and 312 are oriented to be mutually attracted when substrate 12 is folded so that inward-facing surfaces 314 and 316 are proximate each to the other.

Referring to FIGS. 4, 5, 6A, and 6B, embodiment 14 is a bookmark that is a removably attachable plurality of substrates to mark multiple pages in a book or document. Embodiment 14 comprises a plurality of substrates 520 that are fixedly, though not necessarily permanently, attached by means of attachment device 510 near proximal ends 518 a fixed distance 514 from proximal ends 518 of substrates 520. Substrates 520 have predetermined averaged width 522 and length 524 dimensions, and are formed of material that has outward-facing surfaces 616 and inward-facing surfaces 618. In the preferred embodiment, substrates 520 are stacked such that outer-most-facing surface 530 can be decorated with ornaments 534 and indicia 532. Magnet segments 610, 612, and 614 are securely affixed to opposing surfaces 618 and 620 of substrates 630 and 632. Likewise, magnet segment 614 is securely affixed to side 616 of substrate 632, if substrate 632 is not the outer-most-facing surface of the stack, such as substrate 530. Effectively, each opposing side, save out-most-facing sides 530 and 540, of substrates 520 are affixed with magnet segments, thus enabling multiple page marking shown in embodiment 14, FIG. 4.

The material used in the construction of embodiments 10 and 14 can be, but is not limited to, cloth, paper, paperboard, foam, plastic, wood, or synthetics. Indicia 216 and 532 affixed to outward-facing surfaces 214 and 530 can be, but are not limited to, photos, glitter, drawings, and colors. Ornaments 218 and 534 affixed to outward-facing surfaces 214 and 530 can be, but are not limited to, buttons, sprinkles, and charms.

It is thought that the present invention, a placemarker for use in marking a page in a book, and many of its attendant advantages are understood from the foregoing description. It will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A placemarker removably attachable to at least one page of a document, said placemarker comprising:

a plurality of substrates, each substrate of said plurality of substrates having a proximal end and a distal end, each substrate having a first side and a second side, each substrate having edges defining thereby a predetermined and selected geometry whereby said selected geometry has an averaged width dimension and an averaged length dimension;

means for connecting said plurality of substrates together at said proximal ends of each said substrate, said means for connecting forming a stack having at least two outward-facing surfaces;

a plurality of magnet segments, each magnet segment comprising two mutually attractive halves, means for orienting said plurality of magnet segments on said distal ends of said plurality of substrates whereby said two mutually attractive halves of each said magnet segment face each other; and means for attaching said plurality of magnet segments to said distal ends of said plurality of substrates according to a placement determined by said means for orienting.

2. The placemarker according to claim 1 further comprising an indicia attached to at least one of said outward-facing surfaces.

3. The placemarker according to claim 2 wherein said plurality of substrates is formed of a material, said material is selected from the group consisting of cloth, paper, paperboard, plastic, metal, metal alloys, and wood.

4. The placemarker according to claim 3 wherein said indicia is at least one selected from the group consisting of buttons, sprinkles, charms, and photos.

5. The placemarker according to claim 2 wherein said indicia is at least one selected from the group consisting of buttons, sprinkles, charms, and photos.

6. The placemarker according to claim 1 wherein said plurality of substrates is formed of a material, said material is selected from the group consisting of cloth, paper, paperboard, plastic, metal, metal alloys, and wood.

7. A method for making a removably attachable placemarker comprising:

cutting a plurality of substrates to a predetermined geometric shape and a predetermined area dimension, each of said plurality of substrates having a first surface and a second surface, each of said plurality of substrates having a distal end and a proximal end;

orienting a plurality of mutually attractive magnetic segments onto said distal ends of said plurality of substrates, said plurality of mutually attractive magnetic segments each having a first half and a second half whereby said first half and said second half are opposing;

securely attaching first halves of said plurality of mutually attractive magnetic segments to said first sides of each of said plurality of substrates at said distal ends according to said step of orienting;

securely attaching said second half of said mutually attractive magnetic segment to said second sides of each of said plurality of substrates at said distal ends according to said step of orienting;

cutting at least two cover substrates to said predetermined geometric shape and predetermined area dimension, each said cover substrate having a cover substrate outward-facing surface and a cover substrate inward-facing surface, and each said cover substrate having a cover substrate proximal end and a cover substrate distal end;

securely attaching one half of a mutually attractive magnet segment to each of said cover substrate inward-facing surfaces on said cover substrate distal ends; and connecting in sequence one said cover substrate followed by said plurality of substrates followed by another said cover substrate at said cover substrate proximal ends and said proximal ends of said plurality of substrates.

8. The method according to claim 7 further comprising creating a design on at least one said cover substrate outward-facing surface by a creation process selected from a group consisting of stamping, embossing, and glittering.

9. The method according to claim 8 further comprising affixing ornaments, the ornaments selected from a group consisting of buttons and charms to one said outward-facing surface.

10. The method according to claim 7 further comprising affixing ornaments, the ornaments selected from a group consisting of buttons and charms to one said outward-facing surface.

* * * * *